US009299253B2

(12) United States Patent
Eichhorst

(10) Patent No.: US 9,299,253 B2
(45) Date of Patent: Mar. 29, 2016

(54) ADAPTIVE TRAFFIC SIGNAL PREEMPTION

(71) Applicant: Global Traffic Technologies, LLC, St. Paul, MN (US)

(72) Inventor: Kevin Clare Eichhorst, Owatonna, MN (US)

(73) Assignee: Global Traffic Technologies, LLC, St. Paul, MN (US)

( * ) Notice: Subject to any disclaimer, the term of this patent is extended or adjusted under 35 U.S.C. 154(b) by 45 days.

(21) Appl. No.: 14/309,165

(22) Filed: Jun. 19, 2014

(65) Prior Publication Data

US 2015/0371538 A1 Dec. 24, 2015

(51) Int. Cl.
*G08G 1/07* (2006.01)
*G08G 1/087* (2006.01)

(52) U.S. Cl.
CPC ..... *G08G 1/087* (2013.01)

(58) Field of Classification Search
CPC ..... G08G 1/087; G08G 1/07
USPC ..... 340/901–906
See application file for complete search history.

(56) References Cited

U.S. PATENT DOCUMENTS 5,187,476 A 2/1993 Hamer
5,202,683 A 4/1993 Hamer et al.
5,539,398 A * 7/1996 Hall ..... G08G 1/087 340/906
5,602,739 A 2/1997 Haagenstad et al.
5,745,865 A 4/1998 Rostoker et al.
5,926,113 A * 7/1999 Jones ..... G08G 1/07 340/906
5,986,575 A 11/1999 Jones et al.
6,064,319 A * 5/2000 Matta ..... G08G 1/087 340/902
6,236,933 B1 * 5/2001 Lang ..... G08G 1/0104 340/905
6,621,420 B1 9/2003 Poursartip
6,985,090 B2 1/2006 Ebner et al.
7,307,547 B2 12/2007 Schwartz
7,333,028 B2 2/2008 Schwartz
7,417,560 B2 8/2008 Schwartz
7,515,064 B2 4/2009 Schwartz
7,573,399 B2 8/2009 Schwartz
7,898,432 B2 * 3/2011 McNew ..... G08G 1/164 340/905
8,655,575 B2 * 2/2014 Reghunath ..... G08G 1/0112 701/117
2002/0116118 A1 * 8/2002 Stallard ..... G08G 1/01 701/117
2003/0154017 A1 * 8/2003 Ellis ..... A61H 3/061 701/117

(Continued)

FOREIGN PATENT DOCUMENTS

DE 4412528 10/1995
DE 19842912 3/2000

(Continued)

*Primary Examiner* — Hai Phan
*Assistant Examiner* — Royit Yu
(74) *Attorney, Agent, or Firm* — Crawford Maunu PLLC

(57) ABSTRACT

The disclosed approaches for processing traffic signal priority requests include receiving traffic signal priority requests from a vehicle. The number of stopped vehicles at the intersection and on an approach to the intersection is determined in response to receiving each priority request. An activation threshold is computed as a function of an estimated-time-of-arrival (ETA) threshold and the number of stopped vehicles. A vehicle ETA of the vehicle at the intersection is determined in response to each priority request. In response to the vehicle ETA being less than the activation threshold, the priority request is submitted for preemption service processing at the intersection. In response to the vehicle ETA being greater than the activation threshold, submission of the priority request is bypassed for preemption service processing at the intersection.

20 Claims, 3 Drawing Sheets

(56) References Cited

U.S. PATENT DOCUMENTS

2005/0104745 A1 5/2005 Bachelder et al.
2005/0105773 A1* 5/2005 Saito ..... G08G 1/04 382/104
2005/0128103 A1* 6/2005 Bachelder ..... G08G 1/20 340/906
2005/0264431 A1 12/2005 Bachelder
2008/0012726 A1* 1/2008 Publicover ..... G08G 1/095 340/932
2011/0037619 A1* 2/2011 Ginsberg ..... G08G 1/095 340/910
2011/0169661 A1 7/2011 Eichhorst
2012/0065871 A1* 3/2012 Deshpande ..... G08G 1/0133 701/118
2013/0013178 A1* 1/2013 Brant ..... G08G 1/0116 701/117
2013/0018572 A1* 1/2013 Jang ..... G08G 1/164 701/119
2013/0335238 A1* 12/2013 Matsur ..... G08G 1/08 340/906
2014/0247159 A1* 9/2014 Cross ..... G08G 1/087 340/906

FOREIGN PATENT DOCUMENTS

| | | |
|---|---|---|
| DE | 103 41 189 | 8/2004 |
| DE | 10 2007 000634 | 4/2009 |
| JP | 2009 146137 | 7/2009 |
| JP | 2010 044527 | 2/2010 |
| WO | 2005/029437 | 3/2005 |
| WO | 2005094544 | 10/2005 |

* cited by examiner

ADAPTIVE TRAFFIC SIGNAL PREEMPTION

FIELD OF THE INVENTION

The present invention is generally directed to adapting preemption timing for an approaching vehicle according to the number of vehicles stopped at an intersection.

BACKGROUND

Traffic signals have long been used to regulate the flow of traffic at intersections. Generally, traffic signals have relied on timers or vehicle sensors to determine when to change traffic signal lights, thereby signaling alternating directions of traffic to stop, and others to proceed.

Emergency vehicles, such as police cars, fire trucks and ambulances, generally have the right to cross an intersection against a traffic signal. Emergency vehicles have in the past typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

Traffic control preemption systems assist authorized vehicles (police, fire and other public safety or transit vehicles) through signalized intersections by making preemption requests to the intersection controllers that control the traffic lights at the intersections. The intersection controller may respond to the preemption request from the vehicle by changing the intersection lights to green in the direction of travel of the approaching vehicle. This system improves the response time of public safety personnel, while reducing dangerous situations at intersections when an emergency vehicle is trying to cross on a red light. In addition, speed and schedule efficiency can be improved for transit vehicles.

There are presently a number of known traffic control preemption systems that have equipment installed at certain traffic signals and on authorized vehicles. One such system in use today is the OPTICOM® system. This system utilizes a high power strobe tube (emitter), which is located in or on the vehicle, that generates light pulses at a predetermined rate, typically 10 Hz or 14 Hz. A receiver, which includes a photodetector and associated electronics, is typically mounted on the mast arm located at the intersection and produces a series of voltage pulses, the number of which are proportional to the intensity of light pulses received from the emitter. The emitter generates sufficient radiant power to be detected from over 2500 feet away. The conventional strobe tube emitter generates broad spectrum light. However, an optical filter is used on the detector to restrict its sensitivity to light only in the near infrared (IR) spectrum. This minimizes interference from other sources of light.

Intensity levels are associated with each intersection approach to determine when a detected vehicle is within range of the intersection. Vehicles with valid security codes and a sufficient intensity level are reviewed with other detected vehicles to determine the highest priority vehicle. Vehicles of equivalent priority are selected in a first come, first served manner. A preemption request is issued to the controller for the approach direction with the highest priority vehicle travelling on it.

Another common system in use today is the OPTICOM GPS priority control system. This system utilizes a GPS receiver in the vehicle to determine location, speed and heading of the vehicle. The information is combined with security coding information that consists of an agency identifier, vehicle class, and vehicle ID, and is broadcast via a proprietary 2.4 GHz radio.

An equivalent 2.4 GHz radio located at the intersection along with associated electronics receives the broadcasted vehicle information. Approaches to the intersection are mapped using either collected GPS readings from a vehicle traversing the approaches or using location information taken from a map database. The vehicle location and direction are used to determine on which of the mapped approaches the vehicle is approaching toward the intersection and the relative proximity to it. The speed and location of the vehicle are used to determine the estimated time of arrival (ETA) at the intersection and the travel distance from the intersection. ETA and travel distances are associated with each intersection approach to determine when a detected vehicle is within range of the intersection and therefore a preemption candidate. Preemption candidates with valid security codes are reviewed with other detected vehicles to determine the highest priority vehicle. Vehicles of equivalent priority are selected in a first come, first served manner. A preemption request is issued to the controller for the approach direction with the highest priority vehicle travelling on it.

With metropolitan wide networks becoming more prevalent, additional means for detecting vehicles via wired networks, such as Ethernet or fiber optics, and wireless networks, such as cellular, Mesh or 802.11 b/g, may be available. With network connectivity to the intersection, vehicle tracking information may be delivered over a network medium. In this instance, the vehicle location is either broadcast by the vehicle itself over the network or it may be broadcast by an intermediary gateway on the network that bridges between, for example, a wireless medium used by the vehicle and a wired network on which the intersection electronics reside. In this case, the vehicle or an intermediary reports, via the network, the vehicle's security information, location, speed and heading along with the current time on the vehicle, Intersections on the network receive the vehicle information and evaluate the position using approach maps as described in the Opticom GPS system. The security coding could be identical to the Opticom GPS system or employ another coding scheme.

SUMMARY

In a disclosed method of processing traffic signal priority requests, traffic signal priority requests from a vehicle are received at an intersection. A number of stopped vehicles at the intersection and on an approach to the intersection is determined in response to receiving each priority request. An activation threshold is computed as a function of an estimated-time-of-arrival (ETA) threshold and the number of stopped vehicles. A vehicle ETA of the vehicle at the intersection is determined in response to each priority request. In response to the vehicle ETA being less than the activation threshold, the priority request is submitted for preemption service processing at the intersection. In response to the vehicle ETA being greater than the activation threshold, submission of the priority request for preemption service processing at the intersection is bypassed.

A disclosed system for processing traffic signal priority requests includes a priority request receiver that is configured and arranged to receive priority requests. A data collector is configured and arranged to provide data indicative of vehicles at the intersection. A processor is coupled to the priority request receiver and to the data collector, and a memory is coupled to the processor. The memory is configured with instructions that when executed by the processor cause the processor to receive traffic signal priority requests from a vehicle. The processor determines the number of stopped vehicles at the intersection and on an approach to the intersection in response to receiving each priority request and using the data indicative of vehicles at an intersection. An activation threshold is computed as a function of an estimated-time-of-arrival (ETA) threshold and the number of stopped vehicles. A vehicle ETA of the vehicle at the intersection is determined in response to each priority request. In response to the vehicle ETA being less than the activation threshold, the priority request is submitted for preemption service processing at the intersection. In response to the vehicle ETA being greater than the activation threshold, submission of the priority request for preemption service processing at the intersection is bypassed.

The above summary of the present invention is not intended to describe each disclosed embodiment of the present invention. The figures and detailed description that follow provide additional example embodiments and aspects of the present invention.

BRIEF DESCRIPTION OF THE DRAWINGS

Other aspects and advantages of the invention will become apparent upon review of the Detailed Description and upon reference to the drawings in which.

DETAILED DESCRIPTION

Figure 1:
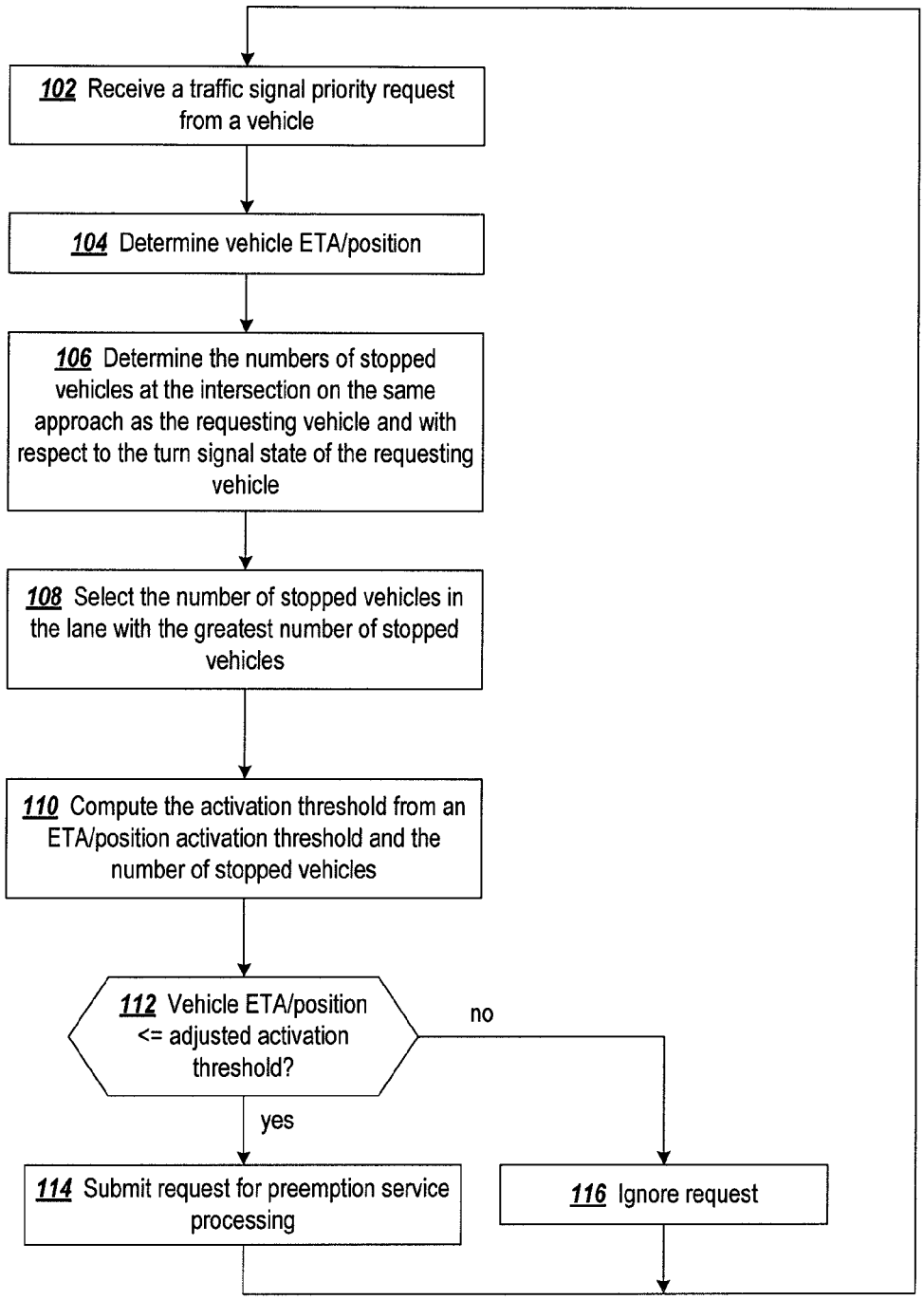
FIG. 1 shows a flowchart of a process for processing priority requests.

In the following description, numerous specific details are set forth to describe specific examples presented herein. It should be apparent, however, to one skilled in the art, that one or more other examples and/or variations of these examples may be practiced without all the specific details given below. In other instances, well known features have not been described in detail so as not to obscure the description of the examples herein. For ease of illustration, the same reference numerals may be used in different diagrams to refer to the same element or additional instances of the same element.

Timely arrival of public safety personnel at the scene of an emergency is critically important. Any delay in traveling to the scene of an emergency may jeopardize the success of emergency relief and rescue efforts. Traffic signal preemption systems play an important role in reducing the travel time for emergency vehicles.

Initiating preemption at an intersection some time before the arrival of the emergency vehicle may be desirable in order to allow time for the traffic signals to cycle to the desired state and the intersection to clear by the time the vehicle arrives at the intersection. Some systems determine when preemption should be triggered at an intersection based on the estimated time of arrival (ETA) of the vehicle at the intersection. The ETA may be determined based on the speed of the vehicle and the distance from the intersection. If the vehicle's ETA is less than a threshold value, preemption may be granted, and if the vehicle's ETA is greater than the threshold value, preemption may be delayed. Either an on-vehicle system or an intersection module may determine the ETA of the vehicle, depending on system implementation.

Various challenges are presented in establishing a suitable threshold at which preemption should be triggered. The threshold should be large enough to provide sufficient time to clear the intersection of pedestrians and stopped traffic before the emergency vehicle arrives at the intersection. If the threshold is too small, the vehicle may have to wait and any stoppage or reduction in the speed of the vehicle will delay the vehicle's arrival at the emergency scene.

In establishing the threshold, a worst-case scenario may be considered. However, a threshold that accommodates the worst-case scenario should be balanced against the likelihood that the worst-case scenario would occur and the likely disruptions caused by preempting much too early when the worst-case scenario is not occurring. If the worst-case scenario is very unlikely and the selected threshold is much too large, traffic flow may be disrupted in other directions and create other preventable problems.

Though historical data could be gathered to determine a suitable threshold, the effort may be impractical. Pedestrian and traffic patterns will vary from one intersection to another, by time of day, by day of the week, and by month. Also, there may be so many intersections that gathering the historical data may not be feasible. In addition, a static threshold may be unsuitable in instances in which there is a wide variance in traffic and pedestrian patterns.

In addressing the challenges associated with defining suitable thresholds for traffic signal preemption at intersections, the disclosed traffic preemption system evaluates real-time traffic conditions at an intersection in order to determine a suitable activation threshold for the intersection. In one implementation, at the time a priority request is received, the system determines the number of vehicles that are stopped at an intersection on the approach of the emergency vehicle. The number of vehicles may be determined using inductive loops buried in the pavement, through still or video image processing at the intersection or though vehicle-to-infrastructure communications such as Dedicated Short Range Communications (DSRC) where Basic Safety Messages report the geographical locations of vehicles which can be used to locate the vehicle on a map of roads and intersections. The number of vehicles may alternatively be determined using radio frequency identification (RFID) tags disposed on vehicles and RFID readers. The number of stopped vehicles is directly proportional to the time required to clear the intersection of those vehicles and allow the emergency vehicle to travel through the intersection without delay.

Based on the determined number of stopped vehicles and a baseline threshold, referred to as the ETA threshold, the system determines an activation threshold. If the vehicle's ETA is less than the activation threshold, the priority request is submitted for preemption service processing at the intersection. If the vehicle's ETA is greater than the activation threshold, the system bypasses submission of the priority request for preemption service processing at the intersection.

FIG. 1 shows a flowchart of a process for processing priority requests. The process determines real-time traffic conditions at an intersection in response to each priority request received from a vehicle and uses the current traffic conditions and ETA of the vehicle to determine whether or not to submit the priority request for preemption of the traffic signal.

At block 102, the process receives a traffic signal priority request. The priority request may be from a light emitter-based signaling device on a vehicle, a radio-based signaling device on a vehicle, or from a centralized traffic control system via a wired or wireless connection. At block 104, the ETA of the vehicle is determined. Depending on the device that is the source of the priority request, the vehicle ETA may be provided along with the priority request from the vehicle. Alternatively, the vehicle device may transmit its GPS coordinates, bearing, and speed along with the priority request to an intersection module, which computes the vehicle ETA. In optical systems, the strength of the optical signal from the vehicle may be used to estimate the distance of the vehicle from the intersection, and an assumed speed may be used to determine the vehicle ETA.

The number of vehicles that are on the same approach as the requesting vehicle and stopped at the intersection is determined at block 106. In an example implementation, if there are multiple traffic lanes on the approach of the requesting vehicle, the process determines the respective number of vehicles stopped in each lane. The approach of the requesting vehicle generally encompasses a region between the intersection and the requesting vehicle along the road the vehicle is traveling. The process of block 106 also accounts for the turn signal state of the requesting vehicle. For example, if the requesting vehicle is signaling a right turn, the number of vehicles in a left-turn lane at the intersection need not be counted. Thus, the determining of the number of stopped vehicles at the intersection on the same approach may exclude selected lanes based on the state of the turn signal. At block 108, the number of vehicles in the traffic lane having the greatest number of stopped vehicles is selected.

The time required to clear the intersection is likely to be dependent on the number of vehicles in the lane having the greatest number of vehicles.

An activation threshold is computed at block 110. The activation threshold is computed as a function of the number of stopped vehicles determined at block 108 and a base threshold, which is also referred to as the ETA threshold. The ETA threshold is representative of an amount of time required to cycle the traffic signals at an intersection in favor of the requesting vehicle. That is, the ETA threshold assumes there are no vehicles stopped at the intersection, and therefore, no time would be required for these vehicles to clear the intersection. The ETA threshold also assumes a vehicle speed that is within established guidelines for emergency vehicles passing through the particular intersection.

In one implementation, the ETA threshold may be increased by a fixed amount of time for each of the number of stopped vehicles. That is a quantity of time may be added to the ETA threshold for each stopped vehicle. For example, if the ETA threshold is 30 seconds, there are 3 stopped vehicles, and 3 seconds are added for each stopped vehicle, the activation threshold may be determined as:

30 seconds+(3 vehicles*3 seconds/vehicle)=39 seconds.

It will be appreciated that in other implementations, the time added to the ETA threshold for each stopped vehicle need not be the same for all vehicles. The added time for each of the first n stopped vehicles could be x seconds, the added time for each additional stopped vehicle may be greater than x seconds. Also, the amount of time added to the activation threshold may vary by vehicle type. For example, larger vehicles, such as tractor-trailers, may require significantly more time to clear an intersection than a small passenger vehicle. Thus, a greater amount of time may be added to the activation threshold for larger vehicles than for smaller vehicles. The different amounts of time added to the activation threshold for different types of vehicles may be referred to as clearance times. In an implementation in which different amounts of time are added to the activation threshold for different types of vehicles, the processing of blocks 106 and 108 may entail determining which lane has the greatest total of clearance times for the stopped vehicles in that lane. For example, two tractor-trailers stopped in one lane may require significantly more time to clear the intersection than 6 or more passenger vehicles stopped in another lane. Thus, the total of the clearance times of vehicles in the lane having the two tractor-trailers would be used in computing the activation threshold.

If the vehicle ETA is less than or equal to the activation threshold, decision block 112 directs the process to block 114 where the priority request is submitted to an intersection controller or traffic signal controller for preemption service. Otherwise, the request is ignored at block 116. It will be recognized in some implementations that the priority request may be queued before submitting the priority request for preemption service. The queuing may be used in scenarios in which there are multiple competing priority requests. The process returns to block 102 to process the next traffic signal priority request.

Those skilled in the art will recognize that distance may be used instead of the ETA if the speed of the requesting vehicle is assumed. At block 104, the position of the vehicle that transmitted the priority request may be determined, and the activation threshold may be a distance that is based on the number of stopped vehicles and a position threshold. For example, if the speed of the vehicle is assumed to be 45 miles/hour (66 feet/second), the distance threshold would be 1980 feet if 30 seconds is the time required to cycle the traffic signals to favor the requesting vehicle. Also, the additional time required to clear each stopped vehicle is assumed to be 3 seconds, the activation threshold may be computed as:

1980 feet+(3 seconds/vehicle*66 feet/second*3 vehicles)=2574 feet

Figure 2:
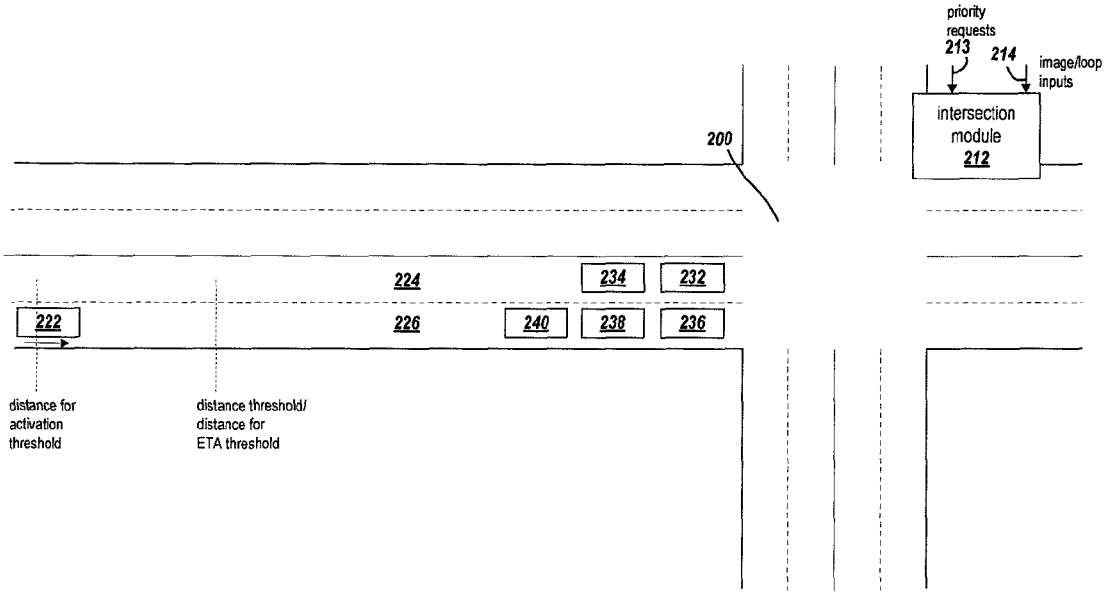
FIG. 2 illustrates an intersection at which a number of vehicles are stopped.

FIG. 2 illustrates an intersection 200 at which a number of vehicles are stopped. An activation threshold is based on the number of stopped vehicles and an ETA threshold or distance threshold. The intersection module 212 receives priority requests 213 from approaching vehicles and determines activation thresholds based on the ETAs of the requesting vehicles and numbers of stopped vehicles at the intersection at the times of the requests. The intersection module receives sensor inputs 214. The sensor inputs provide data from which the intersection module can determine the number of stopped vehicles. The sensor inputs may be signals from inductive loops, still images, video images, or DSRC messages, for example. Inductive loops (not shown) may be embedded in the traffic lanes for detecting the presence of vehicles at the intersection. Multiple loops may be embedded in each lane to detect the presence of multiple vehicles. Instead of the multiple inductive loops in the multiple traffic lanes, one or more still or video cameras (not shown) may be installed at the intersection. The camera(s) provide imagery from which the intersection module may determine the number of stopped vehicles to use in computing the activation threshold.

In the example shown in FIG. 2, vehicle 222 is approaching the intersection and is the source of a priority request received by the intersection module 212. In response to receiving the priority request and lanes 224 and 226 being on the approach of the vehicle 222, the intersection module determines the numbers of vehicles that are in the traffic lanes 224 and 226 based on the sensor input signal 214. Lane 224 has two vehicles 232 and 234, and lane 226 has three vehicles 236, 238, and 240. The three vehicles in lane 226 are used by the intersection module to compute the activation threshold because it would likely take longer to clear the vehicles in lane 226 from the intersection than it would take to clear the vehicles in lane 224.

Figure 3:
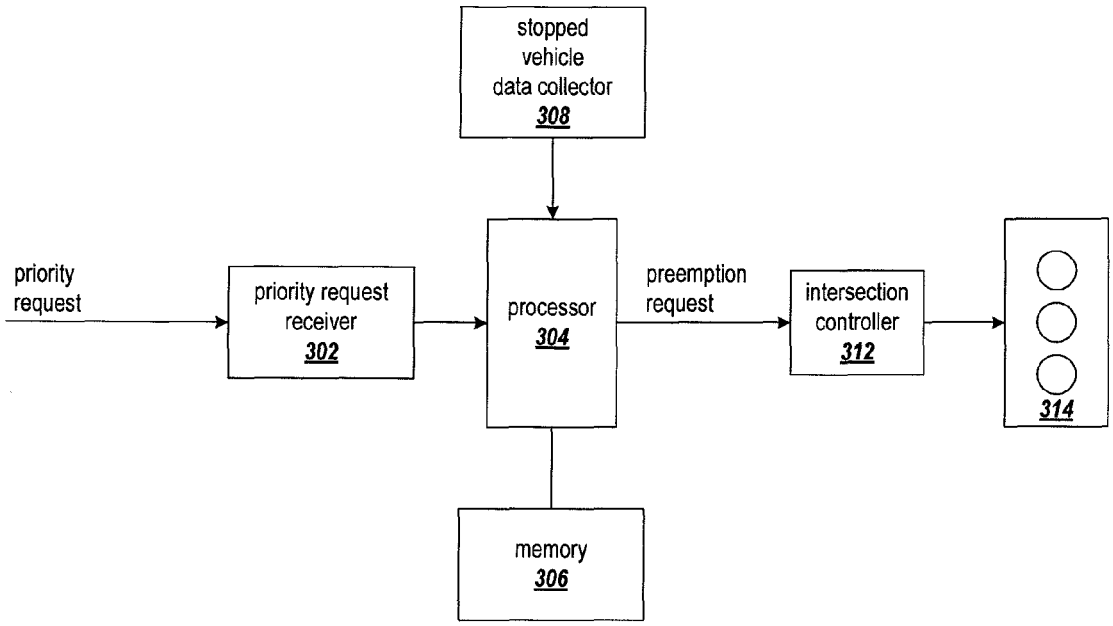
FIG. 3 is a block diagram showing control mechanisms for processing traffic signal priority requests.

FIG. 3 is a block diagram showing control mechanisms for processing traffic signal priority requests. A priority request receiver 302 receives traffic signal priority requests. The priority request may be from a light emitter-based signaling device on a vehicle, a radio-based signaling device on a vehicle, or from a centralized traffic control system via a wired or wireless connection. Thus, the priority request receiver may include photo-detector circuitry (not shown), radio receiver and antenna circuits (not shown), and/or networking circuitry (not shown). In an example implementation, priority request receiver 302 may include circuitry similar to that used in the OPTICOM emitter-based system, and/or the OPTICOM GPS priority control system.

Priority requests are provided by the priority request receiver 302 to the processor 304. The processor is coupled to the memory 306, which is configured with program code that is executable by the processor. Execution of the program code causes the processor to receive the priority requests from the priority request receiver and also input data from the data collector 308. The data collector 308 provides data indicative of vehicles at the intersection. The data may be digital still or video images, signal data from inductive loops, DSRC Basic Safety Messages, or data from an RFID reader. For gathering digital images, the data collector 308 may include one or more image capture devices, such as a digital still camera or a digital video camera. A single camera may suffice if equipped with a 360-degree lens. Otherwise, multiple cameras may be mounted at the intersection to capture images on multiple approaches. Image processing program code in the memory 306 may be executed by the processor 304 to identify vehicles present in the relevant lanes at the intersection and count the number of vehicles present.

Multiple inductive loops may be installed in each traffic lane in which vehicles may be stopped at an intersection. The signal from each inductive loop indicates the presence or absence of a vehicle over the loop. The data collector 308 converts the analog signals from the inductive loops to digital data and provides the data describing the signals to the processor 304. Signal processing program code in the memory 306 may be executed by the processor to determine whether the data representing a signal indicates a vehicle is present and to count the number of vehicles. It will be recognized that known techniques may be used for either identifying vehicles in images or processing signals from inductive loops.

If priority requests are queued, the processor 304 is configured to select one priority request for submitting as a preemption request to intersection controller 312. The priority request may be selected based on a variety of factors such as relative priorities and ages of the requests. Intersection controller 312 controls the phases (the phases including a green phase, a yellow phase, and a red phase, for example) of the traffic signal 314.

The physical disposition of the components at the intersection may vary according to implementation requirements. For example, the priority request receiver 302 and stopped vehicle data collector 308 may be disposed in a housing mounted to the structure (not shown) that supports the traffic signal, and the processor 304 and memory 306 may be separately mounted along with the intersection controller 312 in a separate housing. Alternatively, the processor and memory may be disposed with the receiver and data collector on the signal support structure.

In an example implementation, the processor 304 employs a 32-bit RISC architecture with onboard communications peripherals for Ethernet networking, Universal Serial bus (USB), and serial communications. The processor includes both onboard random-access memory (RAM) and Flash memory for program storage. It will be appreciated that other types of processors may be suitable.

Though aspects and features may in some cases be described in individual figures, it will be appreciated that features from one figure can be combined with features of another figure even though the combination is not explicitly shown or explicitly described as a combination.

The present invention is thought to be applicable to a variety of systems for controlling the flow of traffic. Other aspects and embodiments of the present invention will be apparent to those skilled in the art from consideration of the specification and practice of the invention disclosed herein. It is intended that the specification and illustrated embodiments be considered as examples only, with a true scope of the invention being indicated by the following claims.

What is claimed is:

1. A method of processing traffic signal priority requests, comprising:

receiving at an intersection, a traffic signal priority request from a vehicle;

determining a number of stopped vehicles at the intersection and on an approach to the intersection in response to receiving the priority request;

computing an activation threshold as a function of an estimated-time-of-arrival (ETA) threshold and the number of stopped vehicles;

determining a vehicle ETA of the vehicle at the intersection in response to the priority request;

submitting, in response to the vehicle ETA being less than the activation threshold, the priority request for preemption service processing at the intersection; and bypassing, in response to the vehicle ETA being greater than the activation threshold, submission of the priority request for preemption service processing at the intersection.

2. The method of claim 1, wherein the computing of the activation threshold includes adding a quantity of time to the activation threshold for each vehicle determined to be stopped on the approach at the intersection.

3. The method of claim 1, wherein the determining the number of stopped vehicles includes determining the number of vehicles that are in one lane on the approach.

4. The method of claim 1, wherein the determining the number of stopped vehicles includes:

determining numbers of stopped vehicles in a plurality of lanes on the approach, respectively; and selecting a greatest one of the respective numbers as the number of stopped vehicles at the intersection.

5. The method of claim 1, wherein the determining the number of stopped vehicles includes determining the number of stopped vehicles from signals from inductive loops on the approach at the intersection.

6. The method of claim 5, wherein the computing of the activation threshold includes adding a quantity of time to the activation threshold for each vehicle determined to be stopped on the approach at the intersection.

7. The method of claim 5, wherein the determining the number of stopped vehicles includes determining the number of vehicles that are in one lane on the approach.

8. The method of claim 5, wherein the determining the number of stopped vehicles includes:

determining numbers of stopped vehicles in a plurality of lanes on the approach, respectively; and selecting a greatest one of the respective numbers as the number of stopped vehicles at the intersection.

9. The method of claim 5, further comprising:

determining whether or not the vehicle is on any approach to the intersection in response to receiving the priority request; and in response to determining that the vehicle is not on any approach to the intersection, bypassing the determining the number of stopped vehicles and the computing of the activation threshold and vehicle ETA.

10. The method of claim 1, wherein the determining the number of stopped vehicles includes determining the number of stopped vehicles from digital images of the approach at the intersection.

11. The method of claim 10, wherein the computing of the activation threshold includes adding a quantity of time to the activation threshold for each vehicle determined to be stopped on the approach at the intersection.

12. The method of claim 10, wherein the determining the number of stopped vehicles includes determining the number of vehicles that are in one lane on the approach.

13. The method of claim 10, wherein the determining the number of stopped vehicles includes:

determining numbers of stopped vehicles in a plurality of lanes on the approach, respectively; and selecting a greatest one of the respective numbers as the number of stopped vehicles at the intersection.

14. The method of claim 10, further comprising:

determining whether or not the vehicle is on any approach to the intersection in response to receiving the priority request; and in response to determining that the vehicle is not on any approach to the intersection, bypassing the determining the number of stopped vehicles and the computing of the activation threshold and vehicle ETA.

15. The method of claim 1, further comprising:

determining whether or not the vehicle is on any approach to the intersection in response to receiving the priority request; and in response to determining that the vehicle is not on any approach to the intersection, bypassing the determining the number of stopped vehicles and the computing of the activation threshold and vehicle ETA.

16. The method of claim 1, wherein the determining the number of stopped vehicles includes determining the number of stopped vehicles from Dedicated Short Range Communications (DSRC) Basic Safety Messages transmitted from the stopped vehicles at the intersection.

17. A system for processing traffic signal priority requests, comprising:

a priority request receiver configured and arranged to receive the priority requests;

a data collector configured and arranged to provide data indicative of vehicles at an intersection;

a processor coupled to the priority request receiver and to the data collector;

a memory coupled to the processor, wherein the memory is configured with instructions that when executed by the processor cause the processor to:

receive at the intersection, a traffic signal priority request of the traffic signal priority requests from a vehicle;

determine a number of stopped vehicles at the intersection and on an approach to the intersection in response to receiving the priority request and using the data indicative of vehicles at an intersection;

compute an activation threshold as a function of an estimated-time-of-arrival (ETA) threshold and the number of stopped vehicles;

determine a vehicle ETA of the vehicle at the intersection in response to the priority request;

submit, in response to the vehicle ETA being less than the activation threshold, the priority request for preemption service processing at the intersection; and bypass, in response to the vehicle ETA being greater than the activation threshold, submission of the priority request for preemption service processing at the intersection.

18. The system of claim 17, wherein the data collector is configured to capture digital images.

19. The system of claim 17, wherein the data collector is configured to capture signals from inductive loops.

20. The system of claim 17, wherein the data collector is configured to input messages indicating geographical locations of the vehicles.

* * * * *